United States Patent [19]

Hirmann

[11] 3,983,834

[45] Oct. 5, 1976

[54] PROPULSION SYSTEM FOR WATERCRAFT AND THE LIKE

[76] Inventor: Georg Hirmann, Griesernweg 14, 8037 Zurich, Switzerland

[22] Filed: July 17, 1974

[21] Appl. No.: 489,178

[30] Foreign Application Priority Data

July 23, 1973 Switzerland ..... 10720/73
June 13, 1974 Switzerland ..... 8069/74

[52] U.S. Cl. ..... 115/35; 114/144 R
[51] Int. Cl.[2] ..... B63H 25/42
[58] Field of Search ..... 115/34, 35, 17, 18, 115/41, 70; 114/144 RM, 121, 16 A; 74/484, 491

[56] References Cited

UNITED STATES PATENTS

| | | | |
|---|---|---|---|
| 190,312 | 5/1877 | Gray et al. | 115/35 |
| 1,866,482 | 7/1932 | Olsen | 115/35 |
| 2,045,645 | 6/1936 | Hansen | 115/18 R |
| 2,370,212 | 2/1945 | van Gorden | 115/35 |
| 2,402,724 | 6/1946 | Bidwell | 114/144 R |
| 2,976,836 | 3/1961 | Fageol | 115/35 |
| 3,188,879 | 6/1965 | Conley | 74/491 |
| 3,314,392 | 3/1967 | Molas et al. | 115/18 R |
| 3,377,977 | 4/1968 | Malm | 115/70 |
| 3,442,240 | 5/1969 | Wild et al. | 114/16 A |

*Primary Examiner*—Stephen G. Kunin
*Assistant Examiner*—Sherman D. Basinger
*Attorney, Agent, or Firm*—Pennie & Edmonds

[57] ABSTRACT

A propulsion and control system for watercraft, surface craft and the like wherein at least one thrust generator capable of continuously producing thrusts of variable magnitudes is pivotally mounted to the vehicle in a manner such that it is capable of simultaneous swing movement about at least two axes angularly oriented with respect to each other. The invention includes steering control apparatus operative during normal maneuvering of the watercraft to selectively position the thrust generator in a plurality of orientations with respect to the axes such that selective combinations of thrust magnitudes and directions facilitates selective propulsion and control of the vehicle. The steering control apparatus being positionable during normal maneuvering of the watercraft such that the thrust generator is positionable from forward to reverse and back again for facilitating selective propulsion and control of the craft between corresponding forward and reverse directions.

41 Claims, 27 Drawing Figures

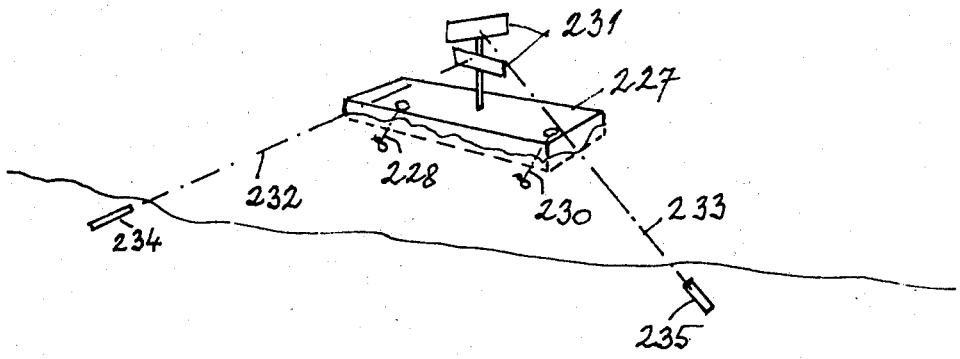
Fig. 23
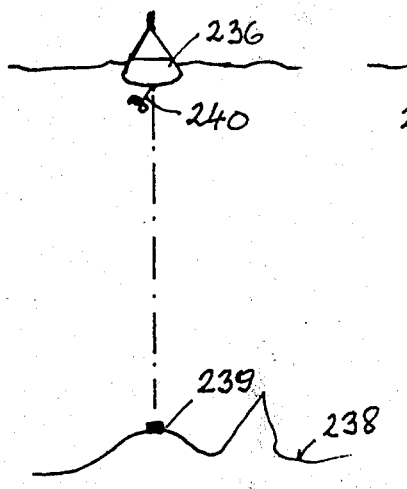
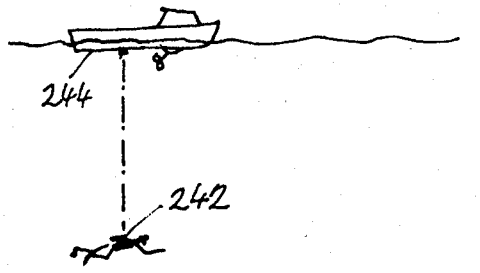
Fig. 24
Fig. 25

PROPULSION SYSTEM FOR WATERCRAFT AND THE LIKE

BACKGROUND OF THE INVENTION

1. Field of the Invention

This invention relates to propulsion and control systems for watercraft, surface craft and the like.

2. Description of the Prior Art

The steering of watercraft by changing the direction of the propelling force generated by a bladed propeller is well known in boats equipped with outboard motors. Such motors are commonly mounted at the stern on an axis of rotation extending essentially parallel to a transmission shaft running downward from the motor with a screw propeller mounted at the lower end and driven by bevel gearing.

Special types have also been disclosed in which the transmission shaft extends vertically downward through a central opening in the hull or other vessel, and is likewise capable of being rotated on a vertical axis by means of a control linkage. Examples of such control linkages are described in U.S. Pat. No. 3,279,417 and German Published Application OS No. 1,781,136.

It is also known, for amphibious craft, that two screw propellers may be arranged at the stern and spaced at a distance from each other. To steer the craft, the propellers are generally capable of swing movement approximately 360° about substantially vertical axes of rotation as shown in German Published Application OS No. 1,141,557. Finally, such propulsion systems have also been fitted near the four corners of the craft, each with a screw propeller capable of being controlled independently as shown in German Published Application OS No. 1,756,531. The individual propulsion units are steered such that the craft may progress either ahead, astern, laterally, or even spin around in place.

The previously known propulsion systems with screw propellers capable of swinging on approximately vertical axes of rotation generally impart sufficient maneuverability for applicable requirements to watercraft equipped with such propulsion systems. This applies particularly to amphibious vehicles having four propulsion systems mounted at the corners and controlled independently of each other. However, such independent drives mounted at the four corners of a watercraft are costly, and their handling calls for experience and skill. Further, it is not possible in the case of all craft to provide several propulsion systems with each being controlled independently. At the same time, such craft fall short of desirable maneuverability. My invention provides a propulsion system for watercraft and the like which, with comparatively simple and economical structures, will substantially improve the steerability while providing a completely novel method of steering and maneuvering.

SUMMARY OF THE INVENTION

The invention relates to a propulsion and control system for watercraft, surface craft, and the like which comprises at least one thrust generator capable of continuously producing thrusts of variable magnitudes, means to pivotally mount said thrust generator to the watercraft in a manner such that it is capable of simultaneous swing movement about at least two axes angularly oriented with respect to each other, and means to selectively position said thrust generator in a plurality of orientations with respect to said axes such that selective combinations of thrust magnitudes and thrust directions with respect to said axes will facilitate selective propulsion and control for the vehicle. The thrust generator, being preferably in the form of a powered screw propeller, is capable of providing thrust vectors variable in direction and magnitude, through any intermediate positions, and/or a neutral position, continuously, as well as in a reverse direction of thrust.

The thrust generator of the propulsion system according to the invention is capable of swing movement about the said axes. The axes may conveniently intersect at right angles to each other at a point thereby forming a universal joint, such that the direction of thrust of the thrust direction may by shifted from any initial position to any other position within a predetermined freedom of motion without a predetermined intermediate position. In this way, a three-dimensionally steerable propulsion system is achieved, usable alike for surface craft, submarine craft and remote-controlled vessels. One or more thrust generators may be provided for one vessel.

In a suitable embodiment of the invention, any thrust generator, which may be a screw propeller, jet nozzle or other unit capable of developing a thrust, may be mounted in a universal suspension permitting the thrust generator to swing in several dimensions.

In the application of the invention to surface craft, a universal mounting of the thrust generator preferably mounts the thrust generator in the bottom of the hull of a boat. The freedom of motion of the thrust generator will be limited essentially to a hemispherical shell extending downward from the point of suspension with the thrust at each setting being in a direction normal to the sphere. A propeller screw as a thrust generator and a drive motor rigidly coupled in a propulsion means provides the steering of the propulsion system by swinging the entire unit on the universal joint in the bottom of the vessel. For example, the steering may be accomplished by means of steering handles fixedly attached to the unit. Alternatively, the motor and propeller may be arranged at a distance from each other. In this case the transmission may be in the form of a universal shaft for example, and a bevel gear is preferably cardanically suspended (e.g. by gimbals) in the bottom of the vessel. In this arrangement the steering may be provided by means acting at the shaft of the propeller in the form of a parallelogram linkage articulated to a likewise universally mounted control stick, and operable by its means to set any direction of thrust within the freedom of motion. Alternatively, the swinging of the thrust generator may be effected by electrical and/or hydraulic means.

In application of the invention to underwater craft, it is desirable to attach the thrust generator or generators to the vessel with three-dimensional freedom of swing, so that the thrust generator can sweep a full sphere around the universal suspension on the vessel. For steering into the direction of thrust from time to time desired, again hydraulic and/or electrical control means may be used.

The invention provides a watercraft propulsion system of simple construction, having high dependability and ease of operation and distinguished by quick and effective control of direction and speed. Changes of direction and speed may be obtained by merely changing the direction of thrust by swinging the propeller. Aside from the possibility of controlling the intensity of the thrust jet generated, say by varying the speed of a screw propeller, by selecting a certain setting angle of the thrust generator, the magnitude of the component of thrust in the particular direction of motion and hence the speed of progress may be determined. By reversing the thrust jet into what is at a given time, the opposite direction, watercraft can be braked in an effective and controlled manner. In braking, by contrast with known propulsion systems, the maximum thrust is available, and by suitable oblique setting of the thrust generator, braking maneuvers may be executed even on a curved course.

Likewise in contradistinction to known propulsion systems, the system according to the invention permits moving astern under full power and with full maneuverability. In addition, with the propulsion according to the invention, external influences such as current, wind or the like can be eliminated without any evasive action. The thrust generator need merely be swung to one side appropriately, which can be done quickly and accurately and will effect corresponding changes in position or direction of the craft.

To especial advantage, propulsion systems according to the invention may be adopted for watercraft as hereinafter enumerated.

1. Small sporting craft for stunting. Such craft, equipped with a propulsion system according to the invention, afford the user more pleasure than conventional motor boats, since in view of the novel method of steering and propulsion, the controls are responded to logically and immediately by corresponding changes of direction. They permit entirely novel maneuvers that cannot be executed with conventional propulsion and steering system.

2. Craft for inland waters, in particular rental boats and craft suitable for taxi service in narrow channels. Especially for craft on inland canals, the accurate maneuverability afforded by the propulsion system according to the invention is advantageous.

3. Rescue and police craft, as well as survey craft, required to be guided accurately over predetermined coordinates for purposes of charting the bottom for example.

4. Propelled unmoored buoys or other floating objects, which may be kept in one position by means of guide beam control for example.

5. Work boats, pushing and towing craft for bridge building. In view of the accurate maneuverability of the propulsion system according to the invention, unmanned units can be accurately moved and positioned.

6. Work boats for cleaning and decontamination of waters, dredges and cranes, research craft (surface or submarine), surface or underwater passenger craft, automatic stations and emergency bases for divers, as well as unmanned surface and submarine observation, measurement of relay stations.

BRIEF DESCRIPTION OF THE DRAWINGS

Preferred embodiments of the invention are described hereinbelow with reference to the drawings wherein:

FIG. 23 shows an application of the invention to controlling the position of a floating object.

FIG. 24 shows an alternative positional control, and

FIG. 25 shows an application of the invention in connection with a monitoring system.

DETAILED DESCRIPTION OF THE PREFERRED EMBODIMENTS

Figure 1:
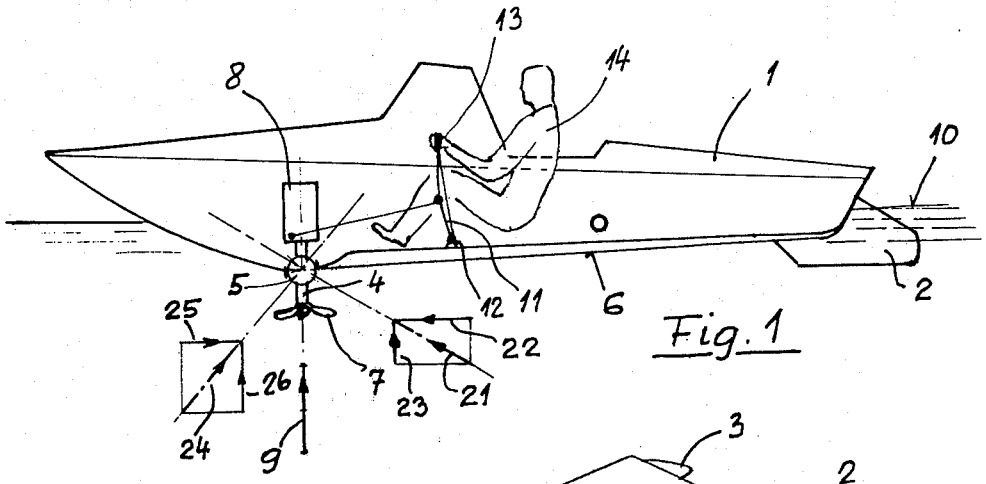
FIG. 1 is a side view of a motor boat with direct drive of a propeller as a thrust generator according to the present invention.
Figure 2:
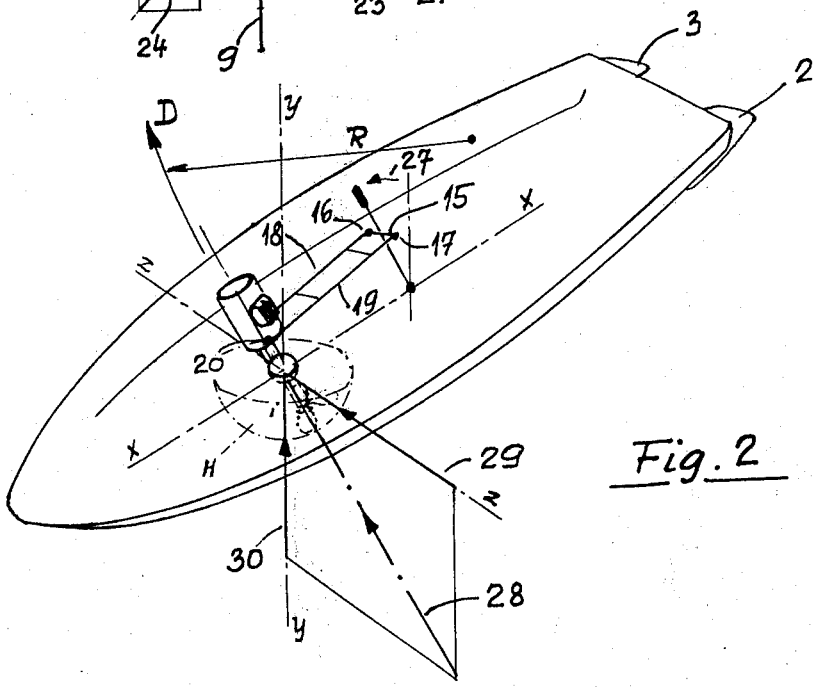
FIG. 2 shows a perspective view of the boat of FIG. 1, with the thrust components plotted for illustration.

The watercraft shown in FIGS. 1 and 2 has a hull 1 with two fixed fins 2, 3 at the stern. Forward of the lateral center of gravity there extends a gear well accommodating the propeller shaft 4, swingably mounted with a ball joint 5 through the bottom 6 of the boat. At one end of the propeller shaft 4 is arranged a propeller screw 7 as thrust generator, and at the other end a drive motor 8. In the figures the propeller shaft 4 is vertical. This is indicated by an arrow 9, pointing vertically towards the surface 10 of the water.

Instead of a screw propeller, other thrust generators may be employed, for example a suitable housed pump rotor, jet nozzle or the like.

In the neutral position of propeller shaft 4 as represented in FIG. 1, which position is indicated by arrow 9 in FIG. 1, the hull experiences no propulsion with propeller screw 7 in operation. Owing to the torque generated with the screw in operation, there can only be a slow rotation of the hull about the vertical axis coinciding with the propeller shaft 4 in the direction opposite the direction of rotation of the screw. Such a rotation, however, may be arrested by a slight inclination of the propeller shaft. To eliminate any rotation of the boat with propeller shaft in neutral position, a second, counterrotating propeller coaxial with the propeller connected to the propeller shaft or a second propulsion unit may be provided. The same or much the same purpose is served by surfaces shrouding the propeller screw of attached like fins 2 to the hull. Alternatively, such rotation may be suppressed by automatically cutting the engine or setting it to idling speed.

The propulsion system is steered by swinging the well containing the propeller shaft and mounted in a ball joint 5 in the bottom of the boat. The steering is done with a control stick 11 one end of which is mounted at the bottom 6 of the hull in a ball joint 12 and the free end of which bears a grip 13 for a skipper 14. Fixedly connected to the control stick 11 is a transverse strut 15, the articulated ends 16, 17 of which are linked to connecting rods 18, 19. The ends of these connecting rods away from the articulations formed by parts 16, 17 are joined by articulations 20 on opposed sides of the housing of the motor 8. By virtue of this arrangement, any movement of the control stick 11 swings the propeller shaft 4 in the direction corresponding to the stick, while the lever ratio between the arm of the motor and the arm of the control stick reduces the deflection required for a given angle.

To progress forward, the control stick 11 is moved forward as indicated by arrow 27 (FIG. 2), towards the bow. The propeller shaft 4 thereby assumes a position directed obliquely astern, say as indicated by arrow 21 in FIG. 1. The resulting forward thrust in this setting of the system is the horizontal component 22 obtained from the thrust parallelogram shown. The accompanying vertical component 23 merely imparts some lift to the hull. From the thrust parallelogram, it is apparent that the component of thrust in the direction of heading and hence the propulsion acting on the hull is greater, the more the propeller shaft approaches a horizontal position. But if the control stick 11 is moved the other way, towards the stern of the boat, the propeller shaft 4 assumes a position according to arrow 24 for example. The component 25 in horizontal direction thus acts as a reverse thrust on the hull. Arrow 26 indicates the lift that occurs in the setting according to arrow 24.

When the control stick 11 is swung to either side, there is a component of thrust directed transverse to the longitudinal axis of the boat, pushing the boat crosswise. If the control stick 11, as in FIG. 2, is moved in the direction of the arrow 27, the propeller shaft 4 follows that direction, but on the opposed side, as indicated by arrow 28 in the diagram, and the boat will rotate approximately about the center of gravity of its lateral aspect. The horizontal component 29 in Z-direction is the thrust moving the boat laterally. The vertical component 30 in Y-direction creates a lift.

In the case of a composite motion of the control stick 11, that is at an angle between the X-axis and the Z-axis, the propeller 7 occupies a position somewhere on the hemisphere H, the center of which is at the joint 5. The result is a motion of the boat corresponding in magnitude and direction to the resultant of thrust. By swinging propeller shaft 4, steering movement in all directions can be obtained, namely ahead, astern, laterally, as well as turning in place.

Figure 3:
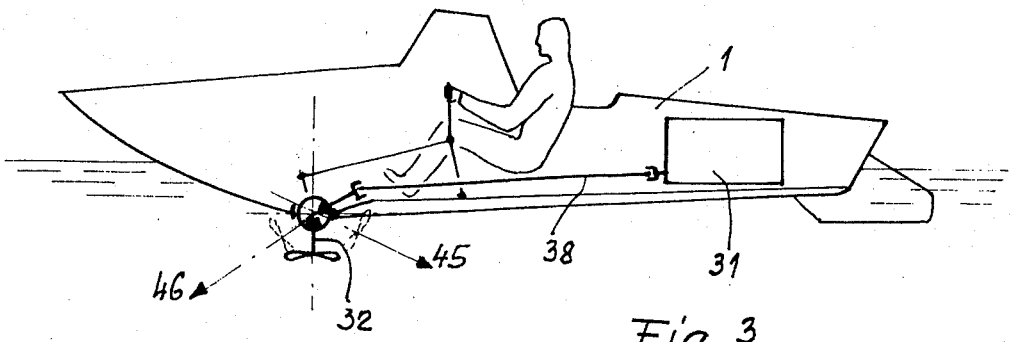
FIG. 3 shows a side view of a modification of the embodiment of a motor boat of FIG. 1, with an indirect drive of a propeller.
Figure 4:
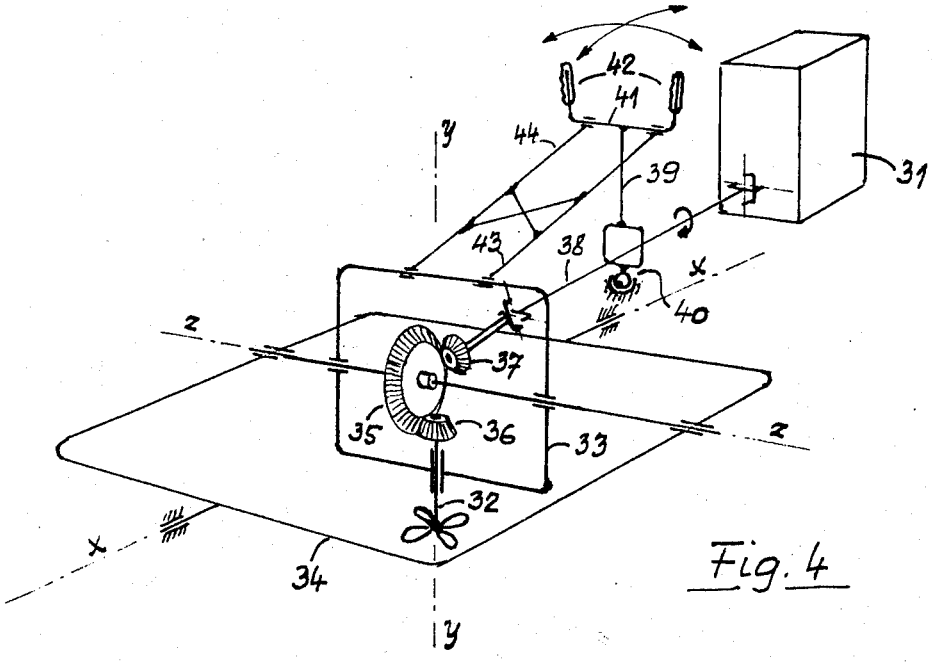
FIG. 4 shows the drive and control members of the boat of FIG. 3 in perspective representation.

If more propulsion power is required, an arrangement as in FIGS. 3 and 4 recommends itself. Here an engine 31 is fixedly installed in the hull 1, while the propeller shaft 32 is rotatably mounted in a frame 33 capable of swinging about the Z-axis, which frame in turn is capable of swinging about the X-axis in a larger frame 34. The frame 33 accomodates a bevel gear 35 mounted rotatably about the Z-axis, and meshing with a bevel gear 36 on the propeller shaft 32 and another bevel gear 37 on a universal shaft 38 driven by the engine 31. In this way, the frame 33 and hence the propeller shaft 32 are capable of swinging both about the Z-axis and, by virtue of frame 34, about the X-axis. Thus it can be seen that all inclinations of the propeller shaft 32 to the Y-axis and hence all required changes of direction of thrust are possible.

The steering is done with a control stick 39 mounted in a ball joint 40 and topped by a cross member 41 with handles 42. The connection between frame 33 and control stick 39 is provided by a rigid linkage 43, 44 swingably mounted at both ends as shown. The propeller shaft 32 can therefore be given any inclination to the Y-axis with control stick 39. Just as in the embodiment of FIGS. 1 and 2, the propeller shaft 32 points in the direction or arrow 45 for motion of the boat ahead, and in the direction of arrow 46 for moving astern.

The inclination of the propeller shaft 32 is not limited to the suggested angular interval. With suitable shape of the bottom of the craft, the propeller shaft 32 can swing all the way into horizontal position, converting the entire thrust into propulsion. The horizontal setting of propeller shaft 32 is convenient also for negotiating shallow waters or transporting the boat over land.

Figure 5:
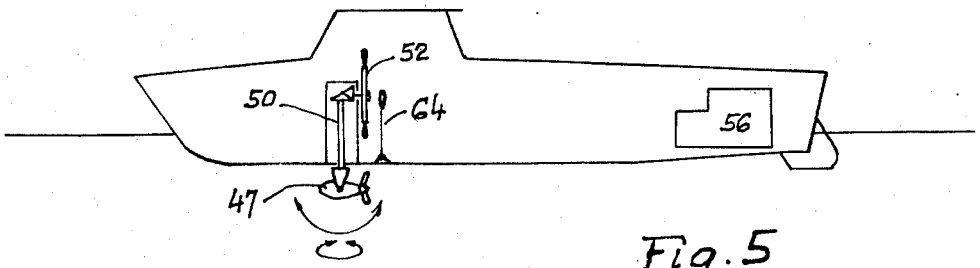
FIG. 5 shows a side view of a further modification in which the control shaft is separated from the drive and mounted to swing in all directions.
Figure 6:
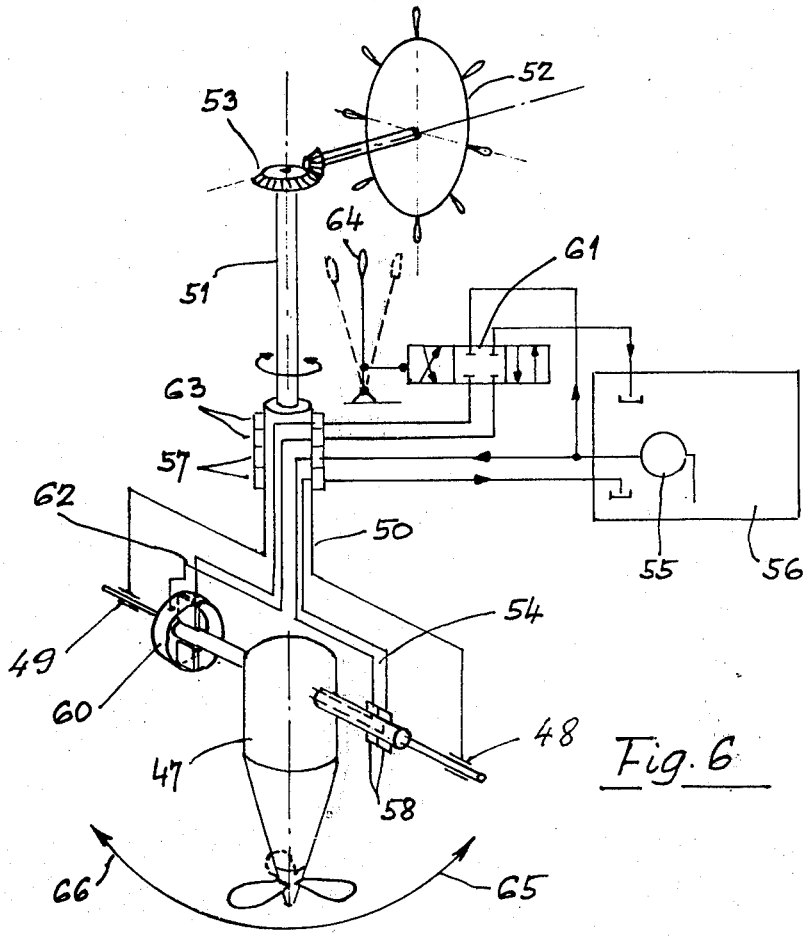
FIG. 6 shows the drive and control system of FIG. 5 in perspective view.

The propulsion system in FIGS. 5 and 6 comprises a hydraulic motor 47, forming one unit with the propeller shaft and propeller screw. The hydraulic motor is mounted by stub shafts 48, 49 in a fork 50, attached to a shaft 51 passing vertically through the bottom of the craft. By rotating shaft 51, the hydraulic motor 47 can be swung over a full circle of 360°, thus setting it to any angle in the horizontal plane. The steering is done with a wheel 52 acting on the shank 51 of the fork by way of bevel gearing 53.

The hydraulic motor 47 is supplied by way of hydraulic lines 54 from a pump 55 arranged inside the boat and driven by an engine 56. The pressure medium is supplied to the hydraulic motor 47 through hydraulic lines 54 by way of chambers 57 through the tubular shaft 51 and corresponding chambers 58 of the likewise tubular pivot 48.

Instead of a hydraulic motor, of course, an electric motor or other system suitable for the purpose may be used.

The hydraulic motor 47 is swung in vertical direction by hydraulic means likewise. This purpose is served by a hydraulic servomotor 60 mounted on pivot 49 and controlled by a slide valve 61. Pressure medium is supplied by hydraulic lines 62 by way of chambers 63 in the forked shaft 51. The slide valve 61 is set in three different positions by means of a control stick 64.

In the middle setting of slide valve 61, the pressure medium in hydraulic lines 62 is stopped, and the hydraulic motor 47 retains the inclination of its then setting in the vertical plane. If the side valve 61 is pushed into the position on the right by pushing the control stick 64 forward, the servomotor 60 swings the drive motor 47 in the direction of the arrow 65 until control stick 64 is returned to the middle slide position. This position of the hydraulic motor 47 propels the boat forward. But if the boat is to be braked or run astern, control stick 64 is pulled back. The shifts the slide valve 61 into its position on the left, and servomotor 60 swings drive motor 47 in the direction of arrow 66.

The position of hydraulic motor 47 at any time may be indicated to the skipper by presently known means. It is likewise possible to employ balanced steering.

Figure 7:
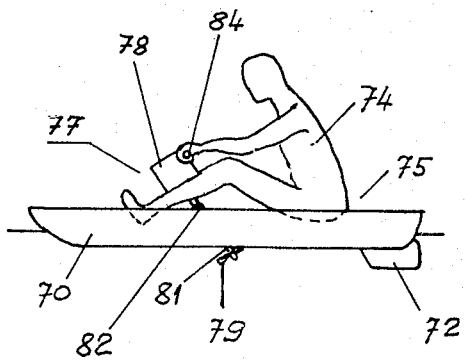
FIG. 7 shows a side view of a motor boat in which the motor and thrust generator are mounted directly on the steering column.
Figure 8:
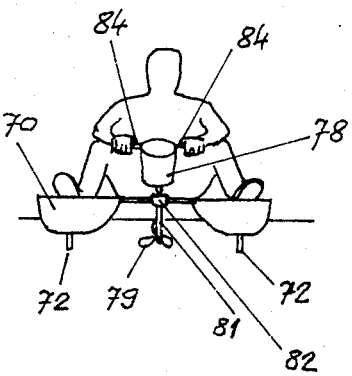
FIG. 8 shows a front view of the motor boat of FIG. 7.

In the embodiment shown in FIG. 7, stabilizing fins 72 are arranged at the stern of a hull 70 at a distance from each other. The rider 74 occupies a seat 75, while the propulsion unit 77 is arranged on the longitudinal axis of the hull 70. The propulsion unit 77 comprises a motor 78 and a thrust generator in the form of a propeller 79. The motor 78 is mounted on a steering column 81, fixed in a frame with a universal suspension 82. The motor 78 is provided with two handlebars 84 by means of which the steering column 81 with motor 78 and propeller 71 is freely movable in the universal suspension 82, so that the horizontal component of the thrust of propeller 79 acting on the hull 70 can be varied in any way for directional control. This embodiment is extremely simple and efficacious in structure, even though the movements to be executed by the rider 74 for steering require greater deflections than would be required if a transmission were interposed, which in principle could be done in this case also.

Figure 9:
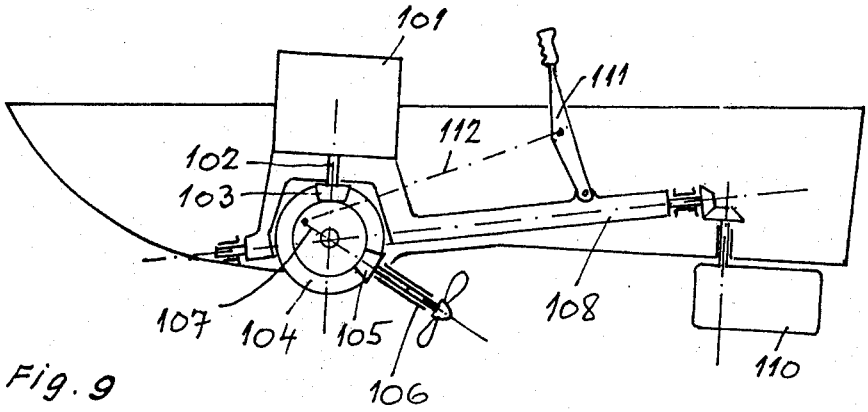
FIG. 9 shows a boat hull with indirect drive of the thrust generator, in side view.

The boat propulsion system shown in FIG. 9 comprises a propulsion engine 101 with drive shaft 102, bevel gear 103, face gear 104, driven bevel gear 105, propeller shaft 106, propeller lever 107, connecting lever 108 with bevel gearing 109, rudder 110 and control lever 111 with connecting rod 112 articulated to the propeller lever 107. By way of this connecting rod, motion of steering lever 111 forward or back swings the propeller shaft 106 correspondingly about a transverse axis of the hull. The entire propulsion system is pivoted on the axis of connecting lever 108 in the hull, so that a lateral swing of lever 108 will swing the engine 101 correspondingly. The weight of the engine may be balanced by suitable means, for example spring means. This arrangement, feasible for moderate power, leads to an extremely simple construction, where, owing to the connection of the rudder 110 to lever 108 by way of bevel gearing 109, suitable rudder deflections consistent with the setting of direction of thrust of the thrust generator and hence an extraordinarily high maneuverability of the boat are obtained.

Figure 10:
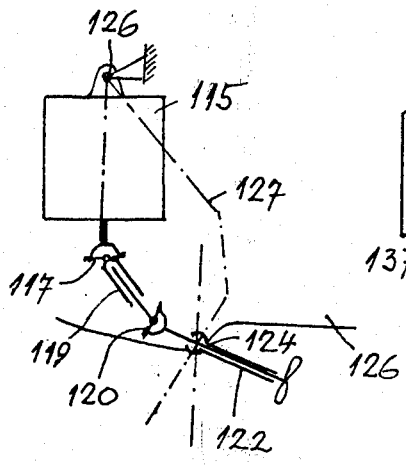
FIG. 10 shows the drive of a propeller having a double universal joint with motor arranged swingably.

In the embodiment of FIG. 10, the propeller shaft 122 is capable of swinging in any direction in a joint 124 arranged in the bottom of the hull, which is shown. The propeller is driven by a motor 115 by way of top and bottom universal joints 117, 122 and a telescoping section 119 arranged between them. To equalize the lateral movements of the transmission parts in steering the propulsion system, the motor 115 is likewise suspended in the hull by an articulation 126. A possible extreme position of the transmission is indicated by the dot-dash line 127.

Figure 11:
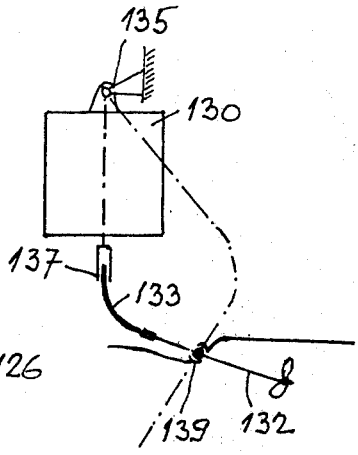
FIG. 11 shows the drive of a propeller having a flexible shaft with a telescoping section for equalization of length, with the motor arranged swingably.

The embodiment illustrated in FIG. 11 is quite similar in structure to that of FIG. 10. Propeller shaft 132, universally mounted at 139 in the bottom of a hull not otherwise shown, is driven by way of a flexible shaft 133 from the drive motor 130. In this embodiment, the motor 130 is suspended in the hull by an articulation 135. Lengthwise equalization of the otherwise longitudinally fixed flexible shaft 133 is permitted by a telescoping part 137 arranged between it and the drive shaft of the motor. A possible swung position of the transmission parts is again indicated by a dot-dash line.

Figure 12:
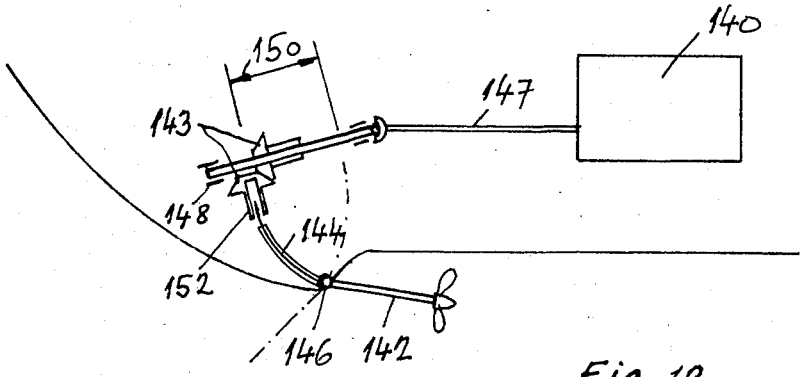
FIG. 12 shows a propeller driven by a motor having bevel gearing and a flexible shaft.

FIG. 12 illustrates the drive connection of a fixedly installed engine 140 with a propeller shaft 142 by way of bevel gearing 143 and a flexible shaft 144. The propeller shaft 142 is mounted at the bottom of the hull in a joint 146, while a drive shaft bearing 148 accomodates the drive shaft 147, of the engine. The offset 150 is occasioned by the freedom to swing in the longitudinal median plane of the craft. At the same time, the flexible shaft 144 is compensated lengthwise by a telescoping part 152.

A similar solution may be obtained by means of a double universal joint as in FIG. 10. The advantage of this arrangement lies in the stationary mounting of the drive motor.

Figure 13:
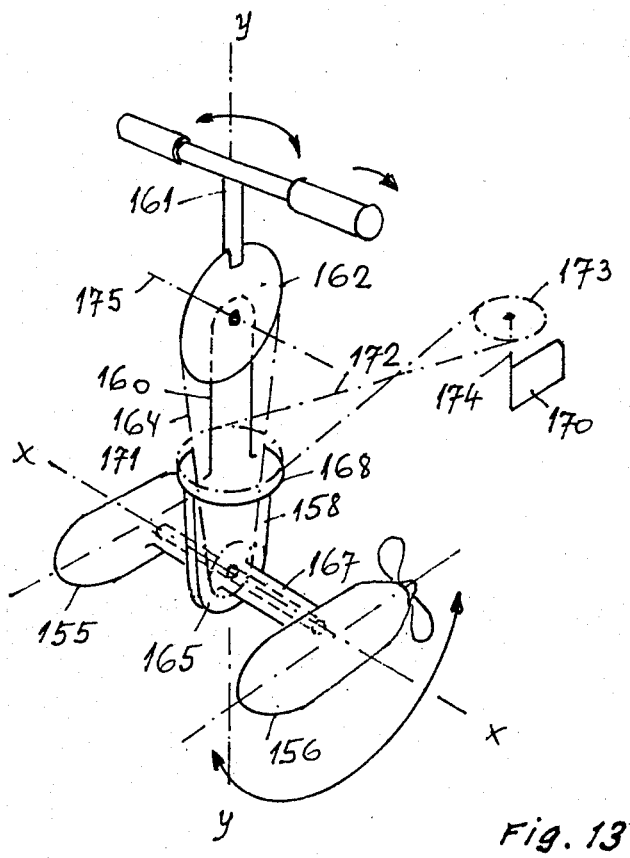
FIG. 13 shows a twin motor drive in perspective view.

FIG. 13 illustrates a twin-motor electric boat propulsion system with motors 155 and 156 capable of swinging together about the x—x axis and bearing propellers, which are mounted on a part 158 capable of swinging about the y—y axis. Part 158 is extended upward by a bracket 160. On this bracket 160 a sprocket wheel 162 with lever 161 is mounted. A chain 164 connects this sprocket wheel to another sprocket wheel 165 fixed on a connecting shaft 167, to the ends of which the housings of drive motors 155 and 156 are fixed. Motors 155, 156 are supplied by way of sliding contacts or flexible lines, not shown, in part 158. The entire system is rotatably attached to the hull, by means of a supporting flange 168.

In addition, the drive may be coupled to a rudder 170, as illustrated in the drawing. This is accomplished by a reversing transmission consisting of a sheave 171 connected to the swinging part 158, a sheave 173 connected to the rudder post 174, and a transmission cord 172 crossing over between said sheaves.

This arrangement functions so that the thrust and the direction of thrust are determined by the rotation about the axis 175, and the lateral steering by swinging about the y—y axis.

A special advantage of this arrangement is the possibility of horizontal direction of the thrust jet and the simplicity of installation.

Figure 14:
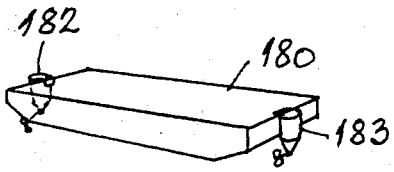
FIG. 14 shows a boat hull with one propulsion unit each mounted at the bow and stern.

FIG. 14 shows the use of two propulsion units to position a float 180. Two propulsion units 182 and 183 may be controlled as required so that their thrusts act in the same direction, additively. In this way, a resultant thrust can be obtained in any direction without rotation of the float 180. It is also possible to produce thrusts in directions different from each other, thus rotating the float 180 about any center. Owing to the fine variation of the two thrusts by inclination of the jet, any kind of motion or position can be achieved with great precision. External influences such as current, wind or the like can be eliminated without any evasive maneuvers such as conventional propulsion systems require.

Figure 14A:
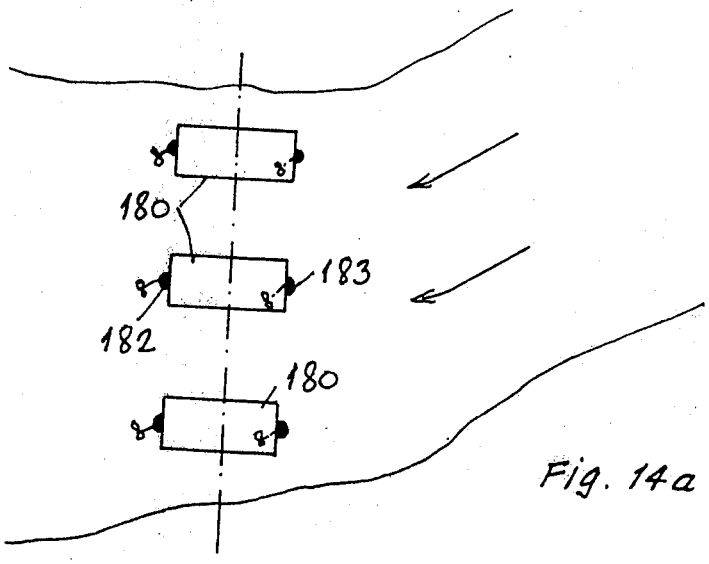
FIG. 14*a* shows three boat hulls as in FIG. 14 in parallel position in a stream.
Figure 14B:
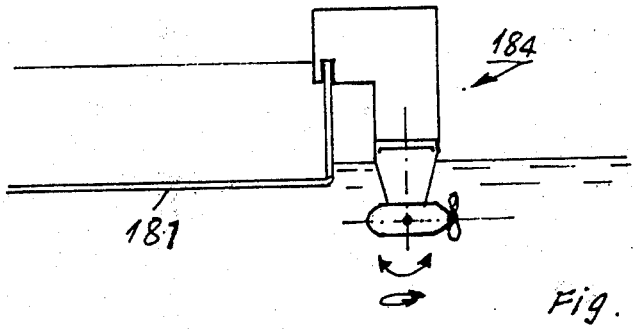
FIG. 14*b* shows a portion of a boat hull as in FIG. 14 with enlarged representation of a propulsion unit.

The drawing shows two propulsion units in so-called outboard form on a pontoon to be used for example in constructing temporary bridges. FIG. 14*a* shows several such pontoons 180 positioned in a stream. The positioning may for example be done by remote control. FIG. 14*b* illustrates a possible arrangement and attachment of a propulsion unit 184 on a hull 181.

Figure 15:
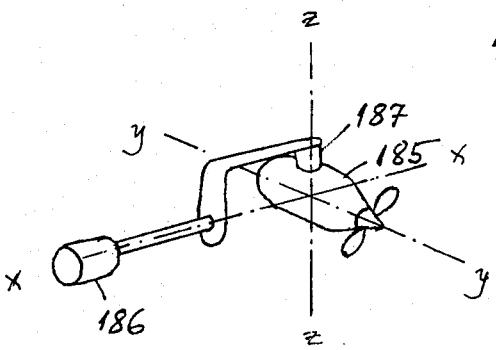
FIG. 15 shows a modified embodiment of a propulsion unit with a propeller as thrust generator.

In the embodiment illustrated in FIG. 15, a screw propeller is mounted on the rotor shaft of an electric motor 185. A servomotor 186 serves to swing the unit about the x—x axis, while for setting about the z—z axis, a servomotor 187 is provided, acting directly on the drive motor.

Such arrangements may be employed, in particular on submarine craft, for generating thrusts freely determinable in three dimensions.

Figure 16:
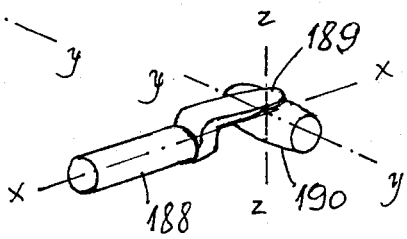
FIG. 16 shows a propulsion system as in FIG. 15 with a jet nozzle as thrust generator.

FIG. 16 shows an embodiment similar to FIG. 15, but with a jet powerplant. The propellant may be contained in a hollow part 188 and supplied to the jet nozzle 190 by way of an articulation 189. This embodiment has the advantage of operating very dependably as a jet nozzle, whether it be a jet power plant, a propulsion nozzle of the like.

Figure 17:
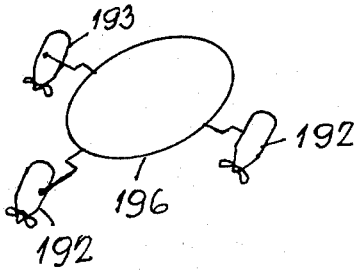
FIG. 17 shows a watercraft having three three-dimensionally steerable propulsion units.

FIG. 17 shows the use of power plants as in FIGS. 15 and 16 in combination with a merely indicated floating object 196. This is associated with three propulsion means 192, 193 and 194, each by itself three-dimensionally controllable. This mode of propulsion enables the body 196 to be steered in any floating position and in any path. The individual units 192, 193, 194 are controlled in a manner explained for FIG. 15.

Figure 18:
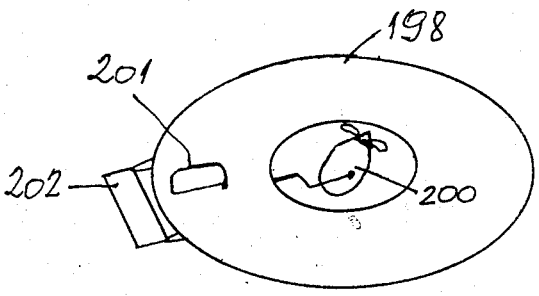
FIG. 18 shows a watercraft having a three-dimensionally acting propulsion unit arranged in a central well.

Referring to FIG. 18, the float illustrated has an annular underwater body 198 with a three-dimensionally operating propulsion unit 200 as in FIG. 15 or 16, arranged in a central well. Propulsion systems of this type are virtually impervious to damage by obstacles. They can execute any change of direction without delay. Floating attitude is determined by control surfaces 201 and 202 and/or by change of direction of thrust.

Figure 19:
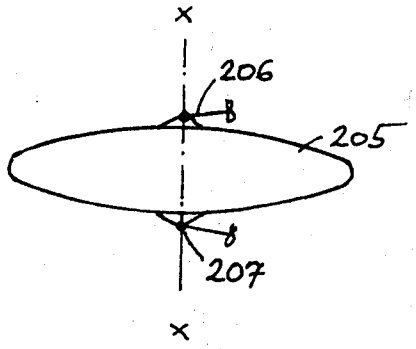
FIG. 19 shows an underwater vessel with propulsion units arranged on opposed surfaces of the hull.

In the underwater floating object 205 of FIG. 19, a propulsion unit 206, 207 is arranged on surfaces opposed to each other, the units being again like those of FIG. 15 or 16. These units may be actuated simultaneously or singly. They provide high dependability under water. At the surface, the hull may be propelled with the bottom unit (for example 207). In this arrangement, without change of position, the hull may be turned transverse to the axis of rotation x—x. A rotation about the axis x—x requires a deflection of a thurst jet by means of control surfaces or similar means not shown.

Figure 20:
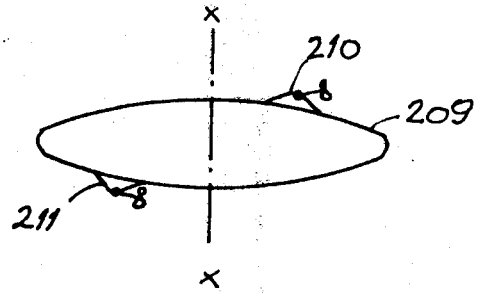
FIG. 20 shows an underwater vessel similar to that of FIG. 19, likewise with two propulsion units on opposed surfaces of the hull, but offset from each other about the axis of rotation x—x of the hull.

In the underwater floating object 209 of FIG. 20, units 210 and 211 are arranged offset with respect to the x—x axis. There is no other difference from the embodiment of FIG. 19. This arrangement provides the additional possibility, by tangential setting of one or both units 210, 211, to execute a rotation about the axis x—x as well.

Figure 21:
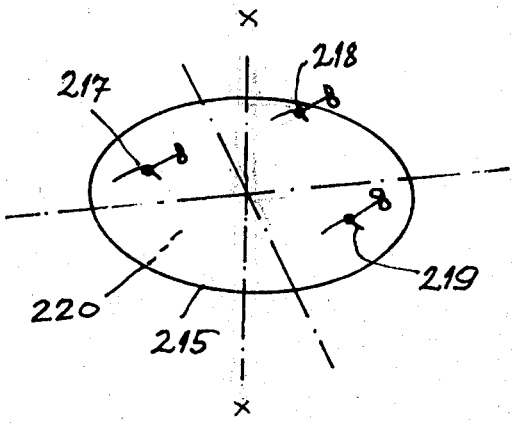
FIG. 21 shows a disc-shaped underwater vessel having three propulsion units arranged on one flat side.

FIG. 21 shows a disc-shaped underwater float 215 with three units 217, 218 and 219 arranged on one flat side. This arrangement affords special advantages in exploring the sea bottom, because firstly there are no transmission parts on the under side 220, thus providing high dependability, and in the second place there is no interference from eddies underneath the float 215. Such submarine craft are able, as is shown in FIG. 17 as well, to execute any stationary or running maneuver. They can be operated at the surface with comparatively low power consumption when capsized, provided the system allows of turning turtle.

Figure 22:
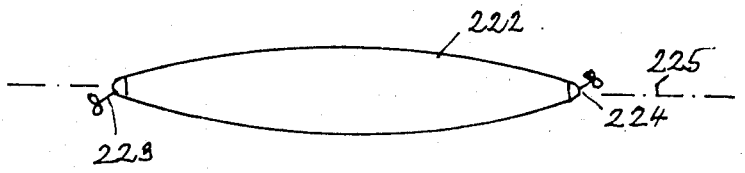
FIG. 22 shows an elongated underwater vessel with propulsion units arranged at the bow and stern.

FIG. 22 shows a similar underwater craft 222 as in FIGS. 19 and 20, but with a unit 223 and 224 each at the bow and stern, which units are again of the type of FIGS. 15 or 16. This arrangement likewise permits any stationary or running maneuver. For rotation about the longitudinal axis 225, at least one of the units must be offset.

In the embodiment of FIG. 23, the invention is applied to positional control of a floating object by directional beams. A float 227 is equipped with two units 228 and 230 controlled in the manner described above and a receiving 231 for two directional beams 232 and 233 from directional beacons 234 and 235.

The directional beam receiving system 231 must be so constructed that within the allowable deviation in position, which may also consist in a rotation of the float about the vertical axis, it will issue correcting orders to the units 228 and/or 230, the inclination of the thrust jet with constant or variable thrust providing a two-dimensional compensation of deflection and/or rotation in this case. Such controls function with extraordinary precision and practically without lag. It is likewise possible to employ such controls spatially (for example three dimensionally) for underwater floating objects as well.

FIG. 24 shows, as another possibility for positional control, for example of a buoy 236, an automatic sounding of a fixed point 239, either transmitting or reflecting signals, on the bottom 238. Then any displacement between buoy 236 and point 239 will control a buoy propulsion unit 240 so as to correct the position.

Obviously the control may also be based on a moving point, as shown in FIG. 25. Thus, for example a driver 242 may be automatically tracked by his accompanying craft 244 with the aid of a transmitter connection.

It is possible also for the propulsion unit or units to be jettisonable or detachable, as may be vital particularly in underwater navigation in critical situations.

I claim:

1. A propulsion and control system for watercraft and the like which comprises at least one automatic power driven thrust generator capable of continuously producing thrusts of variable magnitudes, means to pivotally mount said thrust generator to the watercraft in a manner such that it is capable of simultaneous swing movement about at least two axes angularly oriented with respect to each other, and a single steering control means operative at any time during normal maneuvering of the watercraft to selectively position said thrust generator in a plurality of orientations with respect to said axes such that selective combinations of thrust magnitudes and thrust directions with respect to said axes will facilitate selective propulsion and control for said watercraft, including directing thrust from forward to reverse and back again which facilitates selective propulsion and control for said watercraft between appropriate forward and reverse directions during normal maneuvering of the watercraft.

2. The propulsion and control system according to claim 1 characterized in that the axes of swing intersect at a point and are positioned at right angles to each other, and said thrust generator is mounted for swing movement on a sphere with the center of movement positioned at the point of intersection of said axes, said thrust generator having means to shift the thrust within its freedom of motion from any initial position to any other desired position without predetermined intermediate positions.

3. The propulsion and control system according to claim 2 characterized in that the thrust generator is universally mounted to the watercraft by a ball joint.

4. The propulsion and control system according to claim 3 characterized in that the axis of thrust of the thrust generator is capable of swing movement along three mutually perpendicular axes of orientation.

5. The propulsion and control system according to claim 1 characterized in that the thrust generator is universally mounted to the watercraft by a ball joint.

6. The propulsion and control system according to claim 5 characterized in that the thrust generator is associated with control means in a manner such that a preassigned freedom of motion is obtainable by swinging the thrust generator about its universal mounting with respect to the watercraft.

7. The propulsion and control system according to claim 6 characterized in that the control means comprises a manual control.

8. The propulsion and control system according to claim 1 characterized in that the axis of thrust of the thrust generator is capable of swing movement along three mutually perpendicular axes of orientation.

9. The propulsion and control system according to claim 8 characterized in that the thrust generator is mounted on gimbals to provide a cardanically suspended support.

10. The propulsion and control system according to claim 1 characterized in that the control means for selectively setting the direction of thrust comprises a control member, said member being universally mounted to the watercraft in operative cooperation with the thrust generator.

11. The propulsion and control system according to claim 10 characterized in that the thrust generator is accommodated in a universally mounted frame to which a double linkage effectively connected with the control member is articulated.

12. The propulsion and control system according to claim 1 characterized by arrangement of a three-dimensionally swingable propulsion unit with a thrust generator in a passage through the vessel.

13. The propulsion and control system according to claim 1 characterized by the provision of a floating object with at least one remote-controllable three-dimensional propulsion unit.

14. The propulsion and control system according to claim 1 characterized in that the control means for selectively setting the direction of thrust comprises a control member, said member being universally mounted to the watercraft in operative cooperation with the thrust generator, the controls are assigned an unequal lever ratio to create a mechanical advantage.

15. The propulsion and control system according to claim 14 characterized in that the thrust generator is accommodated in a universally mounted frame to which a double linkage effectively connected with the control member is articulated.

16. The propulsion and control system according to claim 1 characterized in that the control means for selectively setting the direction of thrust comprises a control member, said member being universally mounted to the watercraft in operative cooperation with the thrust generator and a parallelogram linkage so configured so as to render it capable of transmitting a torque for swinging the thrust generator laterally.

17. The propulsion and control system according to claim 16 characterized in that the thrust generator is accommodated in a universally mounted frame to which said parallelogram linkage effectively connected with the control member is articulated.

18. The propulsion and control system according to claim 1 characterized in that the control means for selectively setting the direction of thrust comprises a control member, said member being universally mounted to the watercraft in operative cooperation with the thrust generator, the controls are assigned an unequal lever ratio to create a mechanical advantage, and a parallelogram linkage so configured so as to render it capable of transmitting a torque for swinging the thrust generator laterally.

19. The propulsion and control system according to claim 18 characterized in that the thrust generator is accommodated in a universally mounted frame to which said parallelogram linkage effectively connected with the control member is articulated.

20. The propulsion and control system according to claim 1 characterized in that the thrust generator is mounted on gimbals to provide a cardanically suspended support.

21. The propulsion and control system according to claim 1 characterized by bevel gearing means to connect the control means with the thrust generator.

22. The propulsion and control system according to claim 21 characterized in that the bevel gearing means is arranged in a universally mounted frame adapted to accommodated the mounting of the drive shaft of the thrust generator, said bevel gearing means being coupled to a drive motor by a universal shaft.

23. The propulsion and control system according to claim 21 characterized in that a drive motor is accommodated by a support capable of swinging about a first axis, which in turn accommodates the thrust generator.

24. The propulsion and control system according to claim 23 characterized by a control stick connected to the support rigidly transverse to the axis of swing of the support but flexibly movable in the direction thereof, and effectively coupled with the thrust generator by a linkage which is articulated in relation thereto.

25. A propulsion and control system for watercraft and the like which comprises at least one thrust generator capable of continuously producing thrusts of variable magnitudes, means to pivotally mount said thrust generator to the watercraft in a manner such that it is capable of simultaneous swing movement about at least two axes angularly oriented with respect to each other, and a single steering control means operative at any time during normal maneuvering of the watercraft to selectively position said thrust generator in a plurality of orientations with respect to said axes such that selective combinations of thrust magnitudes and thrust directions with respect to said axes will facilitate selective propulsion and control for said watercraft, the thrust generator being universally mounted to the watercraft by a ball joint, the thrust generator being associated with said control means in a manner such that a preassigned freedom of motion is obtainable by swinging the thrust generator about its universal mounting with respect to the watercraft, said control means for selectively setting the direction of thrust comprises a control member, said member being universally mounted to the watercraft in operative cooperation with the thrust generator, the cooperation between the control member comprises a control stick and the axis of thrust is mediated by a double parallelogram linkage articulated to the control stick and on either side of the axis of thrust to the thrust generator with a drive motor connected thereto.

26. The propulsion and control system according to claim 25 characterized in that the controls are assigned an unequal lever ratio to create a mechanical advantage.

27. The propulsion and control system according to claim 26 characterized in that the parallelogram linkage is so configured so as to render it capable of transmitting a torque for swinging the thrust generator laterally.

28. The propulsion and control system according to claim 25 characterized in that the parallelogram linkage is so configured so as to render it capable of transmitting a torque for swinging the thrust generator laterally.

29. A propulsion and control system for watercraft and the like which comprises at least one thrust generator capable of continuously producing thrusts of variable magnitudes, means to pivotally mount said thrust generator to the watercraft in a manner such that it is capable of simultaneous swing movement about at least two axes angularly oriented with respect to each other, and a single steering control means operative at any time during normal maneuvering of the watercraft to selectively position said thrust generator in a plurality of orientations with respect to said axes such that selective combinations of thrust magnitudes and thrust directions with respect to said axes will facilitate selective propulsion and control for said watercraft, including directing thrust from forward to reverse and back agains which facilitates selective propulsion and control for said watercraft between appropriate forward and reverse directions during normal maneuvering of the watercraft, the thrust generator is universally mounted to the watercraft by a ball joint and a drive motor for the thrust generator is directly connected thereto.

30. The propulsion and control system according to claim 29 characterized in that the drive motor and the thrust generator form a rigidly assembled propulsion unit.

31. The propulsion and control system according to claim 30 characterized by arrangement of the universal mounting of the thrust generator a gear well accommodating the drive shaft for a propeller.

32. A propulsion and control system for watercraft and the like which comprises at least one thrust generator capable of continuously producing thrusts of variable magnitudes, means to pivotally mount said thrust generator to the watercraft in a manner such that it is capable of simultaneous swing movement about at least two axes angularly oriented with respect to each other, and a single steering control means operative at any time during normal maneuvering of the watercraft to selectively position said thrust generator in a plurality of orientations with respect to said axes such that selective combinations of thrust magnitudes and thrust directions with respect to said axes will facilitate selective propulsion and control for said watercraft, including directing thrust from forward to reverse and back again which facilitates selective propulsion and control for said watercraft between appropriate forward and reverse directions during normal maneuvering of the watercraft, the axes of swing intersect at a point and are positioned at right angles to each other, and said thrust generator is mounted for swing movement on a sphere with the center of movement positioned at the point of intersection of said axes, said thrust generator having means to shift the thrust within its freedom of motion from any initial position to any other desired position without predetermined intermediate positions, the thrust generator is universally mounted to the watercraft by a ball joint, and a drive motor for the thrust generator is directed connected thereto.

33. The propulsion and control system according to claim 32 characterized in that the drive motor and the thrust generator form a rigidly assembled propulsion unit.

34. The propulsion and control system according to claim 33 characterized by arrangement of the universal mounting of the thrust generator a gear well accommodating the drive shaft for a propeller.

35. A propulsion and control system for watercraft and the like which comprises at least one thrust generator capable of continuously producing thrusts of variable magnitudes, means to pivotally mount said thrust generator to the watercraft in a manner such that it is capable of simultaneous swing movement about at least two axes angularly oriented with respect to each other, and a single steering control means operative at any time during normal maneuvering of the watercraft to selectively position said thrust generator in a plurality of orientations with respect to said axes such that selective combinations of thrust magnitudes and thrust directions with respect to said axes will facilitate selective propulsion and control for said watercraft, including directing thrust from forward to reverse and back again which facilitates selective propulsion and control for said watercraft between appropriate forward and reverse directions during normal maneuvering of the watercraft, the thrust generator is universally mounted to the watercraft by a ball joint, the axis of thrust of the thrust generator is capable of swing movement along three mutually perpendicular axes of orientation, and a drive motor for the thrust generator is directly connected thereto.

36. The propulsion and control system according to claim 35 characterized in that the drive motor and the thrust generator form a rigidly assembled propulsion unit.

37. The propulsion and control system according to claim 36 characterized by arrangement of the universal mounting of the thrust generator in a gear well accommodating the drive shaft for a propeller.

38. A propulsion and control system for watercraft and the like which comprises at least one thrust generator capable of continuously producing thrusts of variable magnitudes, means to pivotally mount said thrust generator to the watercraft in a manner such that it is capable of simultaneous swing movement about at least two axes angularly oriented with respect to each other, and a single steering control means operative at any time during normal maneuvering of the watercraft to selectively position said thrust generator in a plurality of orientations with respect to said axes such that selective combinations of thrust magnitudes and thrust directions with respect to said axes will facilitate selective propulsion and control for said watercraft, including directing thrust from forward to reverse and back again which facilitates selective propulsion and control for said watercraft between appropriate forward and reverse directions during normal maneuvering of the watercraft, the axes of swing intersect at point and are positioned at right angles to each other, and said thrust generator is mounted for swing movement on a sphere with the center of movement positioned at the point of intersection of said axes, said thrust generator having means to shift the thrust within its freedom of motion from any initial position to any other desired position without predetermined intermediate positions, the thrust generator is universally mounted to the watercraft by a ball joint, the axis of thrust of the thrust generator is capable of swing movement along three mutually perpendicular axes of orientation, and a drive motor for the thrust generator is directly connected thereto.

39. The propulsion and control system according to claim 38 characterized in that the drive motor and the thrust generator form a rigidly assembled propulsion unit.

40. The propulsion and control system according to claim 39 characterized by arrangement of the universal mounting of the thrust generator in a gear well accommodating the drive shaft for a propeller.

41. A propulsion and control system for watercraft and the like which comprises at least one thrust generator capable of continuously producing thrusts of variable magnitudes means to pivotally mount said thrust generator to the watercraft in a manner such that it is capable of simultaneous swing movement about at least two axes angularly oriented with respect to each other, and a single steering control means operative at anytime during normal maneuvering of the watercraft to selectively position said thrust generator in a plurality of orientations with respect to said axes such that selective combinations of thrust magnitudes and thrust directions with respect to said axes will facilitate selective propulsion and control for said watercraft, including directing thrust from forward to reverse and back again which facilitates selective propulsion and control for said watercraft between appropriate forward and reverse directions during normal maneuvering of the watercraft, the thrust generator is universally mounted to the watercraft by a ball joint, the thrust generator is associated with control means in a manner such that a preassigned freedom of motion is obtainable by swinging the thrust generator about its universal mounting with respect to the watercraft, the control means comprises a manual control, said thrust generator and drive motor are rigidly connected to each other and said manual control includes handles attached directly to the propulsion unit to swing the axis of thrust.

* * * * *